US010256059B2

(12) United States Patent
Liu et al.

(10) Patent No.: US 10,256,059 B2
(45) Date of Patent: Apr. 9, 2019

(54) MAGNETIC SWITCH

(71) Applicant: CHUANDONG MAGNETIC ELECTRONIC CO., LTD, Foshan, Guangdong (CN)

(72) Inventors: Li Liu, Guangdong (CN); Ke Wen Long, Guangdong (CN)

(73) Assignee: CHUANDONG MAGNETIC ELECTRONIC CO., LTD (CN)

( * ) Notice: Subject to any disclaimer, the term of this patent is extended or adjusted under 35 U.S.C. 154(b) by 0 days.

(21) Appl. No.: 15/532,098

(22) PCT Filed: Oct. 14, 2015

(86) PCT No.: PCT/CN2015/091931
§ 371 (c)(1),
(2) Date: May 31, 2017

(87) PCT Pub. No.: WO2016/124003
PCT Pub. Date: Aug. 11, 2016

(65) Prior Publication Data

US 2017/0271111 A1 Sep. 21, 2017

(30) Foreign Application Priority Data

Feb. 3, 2015 (CN) ..... 2015 1 0055579

(51) Int. Cl.
*H01H 9/00* (2006.01)
*H01H 33/08* (2006.01)
(Continued)

(52) U.S. Cl.
CPC ..... *H01H 33/08* (2013.01); *H01H 1/26* (2013.01); *H01H 9/30* (2013.01); *H01H 33/025* (2013.01);
(Continued)

(58) Field of Classification Search
CPC ..... H01H 33/02; H01H 33/08; H01H 33/00; H01H 33/025; H01H 36/0073; H01H 2205/002
(Continued)

(56) References Cited

U.S. PATENT DOCUMENTS 2,317,310 A * 4/1943 Stern ..... G03B 21/00 217/12 R
2,571,068 A * 10/1951 Seiden ..... H01H 51/10 200/1 A
(Continued)

FOREIGN PATENT DOCUMENTS

CN 2682556 Y 3/2005
CN 201421805 Y 3/2010
(Continued)

*Primary Examiner* — Mohamad A Musleh
*Assistant Examiner* — Lisa N Homza

(57) ABSTRACT

A novel magnetic switch, comprising a housing, a terminal A and a terminal B, wherein an inner cavity of the housing is internally provided with a magnetic body and a tongue plate, one end of the tongue plate is movably connected to the upper end of the terminal B, the magnetic body, which is integrally linked to the tongue plate, is capable of being raised thereon; the other end of the tongue plate is disposed above the terminal A; the upper end of the terminal A is provided with an arc-removing apparatus, the arc-removing apparatus is provided with a stationary contact, and the other end of the tongue plate is provided with a movable contact. The magnetic switch has an effective structure, thus improving the work stability and prolonging the service life of the switch.

9 Claims, 3 Drawing Sheets

(51) Int. Cl.
*H01H 33/02* (2006.01)
*H01H 36/00* (2006.01)
*H01H 1/26* (2006.01)
*H01H 9/30* (2006.01)

(52) U.S. Cl.
CPC ... *H01H 36/0073* (2013.01); *H01H 2205/002* (2013.01)

(58) Field of Classification Search
USPC ..... 335/207, 131
See application file for complete search history.

(56) References Cited

U.S. PATENT DOCUMENTS 2,866,030 A * 12/1958 Wirth, Jr. ..... H01H 50/56 174/50.5
2,872,547 A * 2/1959 Diebold ..... H01H 50/42 200/288
3,418,608 A * 12/1968 Angel ..... H01H 50/58 335/131
3,624,332 A * 11/1971 Van Benschoten ..... H01H 1/18 200/241
4,216,358 A * 8/1980 Brozille ..... H01H 3/001 200/240
4,229,719 A * 10/1980 Lemmer ..... H01H 50/14 335/132
4,475,093 A * 10/1984 Kobler ..... H01H 49/00 335/125
4,618,842 A * 10/1986 Nestlen ..... H01H 50/026 335/127
4,647,885 A * 3/1987 Maenishi ..... H01H 51/2227 335/230
4,686,500 A * 8/1987 Ide ..... H01H 50/546 335/128
4,739,292 A * 4/1988 DeKoster ..... H01H 51/28 200/275
4,910,484 A * 3/1990 Shikano ..... H01H 50/305 335/240
4,972,166 A * 11/1990 Mitsch ..... H01H 1/34 335/128
5,003,274 A * 3/1991 Chikira ..... H01H 1/18 335/128
5,151,675 A * 9/1992 Biehl ..... H01H 1/2075 335/128
5,574,416 A * 11/1996 Maruyama ..... H01H 51/2227 335/78
5,801,608 A * 9/1998 Mader ..... H01H 50/54 335/128
5,844,456 A * 12/1998 Mader ..... H01H 50/026 335/78
5,864,268 A * 1/1999 Hoffmann ..... H01H 49/00 335/128
5,955,714 A 9/1999 Reneau
5,969,586 A * 10/1999 Noda ..... H01H 50/642 200/283
6,075,429 A * 6/2000 Uotome ..... H01H 9/443 335/129
6,424,244 B1 * 7/2002 Hendel ..... H01H 51/2209 335/177
7,005,593 B2 * 2/2006 Gasparyan ..... H01H 29/00 200/182
7,859,372 B2 * 12/2010 Ciocirlan ..... H01H 1/50 200/252
8,373,524 B1 * 2/2013 Villarin ..... H01H 1/225 335/78
2006/0226935 A1 * 10/2006 Kon ..... H01H 1/18 335/78

FOREIGN PATENT DOCUMENTS

CN 204424161 U 6/2015
CN 203950738 U 11/2015

* cited by examiner

MAGNETIC SWITCH

TECHNICAL FIELD OF THE INVENTION

The present invention relates to the technical field of proximity switches, and more particularly, to a novel magnetic switch.

BACKGROUND OF THE INVENTION

A traditional reed-type magnetic proximity switch is limited by 2.5 A electric current limitation. Although great improvements have been made in the large-current (e.g., 5 A, 10 A) structure of non-reed magnetic switches, problems such as electric arcing contact-melting and ablating oxidation still exist due to unbearable instantaneous large currents. Thus, the shortcomings of traditional magnetic switches are urgent problems that need to be solved for those skilled in this field.

SUMMARY OF THE INVENTION

The purpose of the present invention is to solve the shortcomings in the prior art and provide a novel magnetic switch having an arc-removing apparatus, which can solve the problems relating to electric arcing contact-melting and ablating oxidation under an instantaneous large current.

To achieve the above purpose, the present invention adopts the following technical solution:

A novel magnetic switch, comprising a housing having an open end, a terminal A and a terminal B; a housing cover is disposed at the open end of the housing; the terminal A and the terminal B are inserted in parallel into the housing and the base plate of the housing cover; an inner cavity of the housing is internally provided with a magnetic body and a tongue plate; one end of the tongue plate is movably connected to the upper end of the terminal B; the magnetic body is integrally linked to the tongue plate and is capable of being raised thereon. The other end of the tongue plate is disposed above the terminal A; the upper end of the terminal A is provided with an arc-removing apparatus; the arc-removing apparatus is provided with a stationary contact, and the other end of the tongue plate is provided with a movable contact.

In another aspect of the present invention, the arc-removing apparatus comprises a three-clawed fixing frame. The three-clawed fixing frame, which is horizontally connected to the upper end of the terminal A, is provided with an arc-removing plate. The arc-removing plate is provided with a stationary contact.

In another aspect of the present invention, the three-clawed fixing frame comprises three fixing claws that are horizontally fixed to the upper end of the terminal A, wherein two fixing claws are disposed on one side of the upper end of the terminal A, and the other fixing claw, which is disposed on the other side of the upper end of the terminal A, is disposed between the said two fixing claws disposed on one side of the terminal A. The two ends of the arc-removing plate are respectively connected to the fixing claws disposed on the two sides of the terminal A.

In another aspect of the present invention, the outer end of the fixing claw is vertically provided with a baffle, and the inner side surface of the baffle is provided with a recessed first angled slot. The two end edges of the arc-removing plate are correspondingly engaged with the first angled slots of the baffles disposed on two sides.

In another aspect of the present invention, the arc-removing plate is configured as a flat hollow square. The inner hole of the arc-removing plate is provided with an elastic piece. A fixing end of the elastic piece is connected to the inner edge of one side plate of the arc-removing plate, and a free end of the elastic piece can freely bounce within the arc-removing plate. The elastic piece and the arc-removing plate are configured to be an integral body. The other end of the elastic piece is provided with a fixing hole, which is disposed to correspond to the other end of the tongue plate. The stationary contact is connected to the fixing hole.

In another aspect of the present invention, the tongue plate is provided with a mounting slot, and the upper end of the terminal B is provided with a transfer plate. The left end of the transfer plate is provided with an inclined wedge block, and the right end of the transfer plate is provided with an upright engaging plate. The outer side surface of the engaging plate is provided with a recessed second angled slot. The engaging plate is inserted into the mounting slot, and the inner edge of the tongue plate disposed at the right end of the mounting slot is engaged with the second angled slot. A curved elastic supporting piece is disposed between the inclined wedge block and the tongue plate of the left end of the mounting slot.

In another aspect of the present invention, the inclined wedge block is configured to be T-shaped. The lower end of the upright plate of the inclined wedge block is fixed to the transfer plate. The right end of the supporting piece is provided with an engaging slot, and the engaging slot interacts with the upright plate of the inclined wedge block. The tongue plate of the left end of the mounting slot is provided with a locating slot. The left end of the supporting piece is provided with an insertion piece, and the insertion piece is inserted into the locating slot.

In another aspect of the present invention, the tongue plate of the left end of the mounting slot is provided with a fixing plate. The magnetic body is disposed on the fixing plate and is integrally linked with the tongue plate. The fixing plate is made from non-magnetic copper material.

Compared with the prior art, the present invention has the following advantages: The present invention has a reasonable structure: the terminal A is provided with an arc-removing apparatus, thus avoiding the oxidation phenomenon from occurring on the surface of the contacts through the arc-removing plate when the terminal B is connected to the terminal A through the tongue plate. Consequently, the present invention has greater structural stability, better function, and a longer functional life. Meanwhile, the arc-removing plate is provided with a curved elastic piece, which can push the contacts to be separated from each other when the load is too high, thereby improving the use safety of the magnetic switch and electrical appliances. Furthermore, the present invention has a compact structure, which is easy to assemble while satisfying requirements of electrical installation standards.

BRIEF DESCRIPTION OF THE DRAWINGS

To clearly expound the present invention or technical solution, the drawings and embodiments are hereinafter combined to illustrate the present invention. Obviously, the drawings are merely some embodiments of the present invention and those skilled in the art can associate themselves with other drawings without paying creative labor.

MARKING INSTRUCTIONS OF THE DRAWINGS

Figure 1:
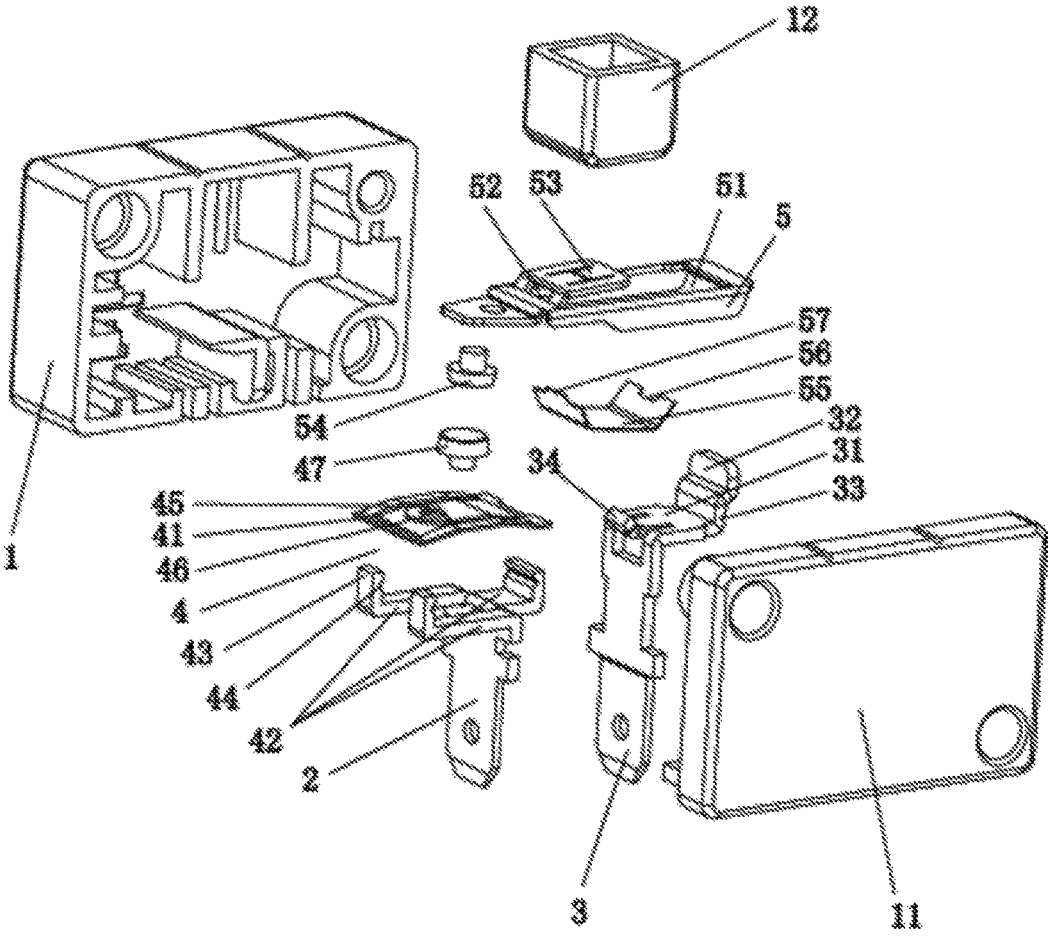
FIG. 1 is an explosive view of the integral structure of the present invention.
Figure 2:
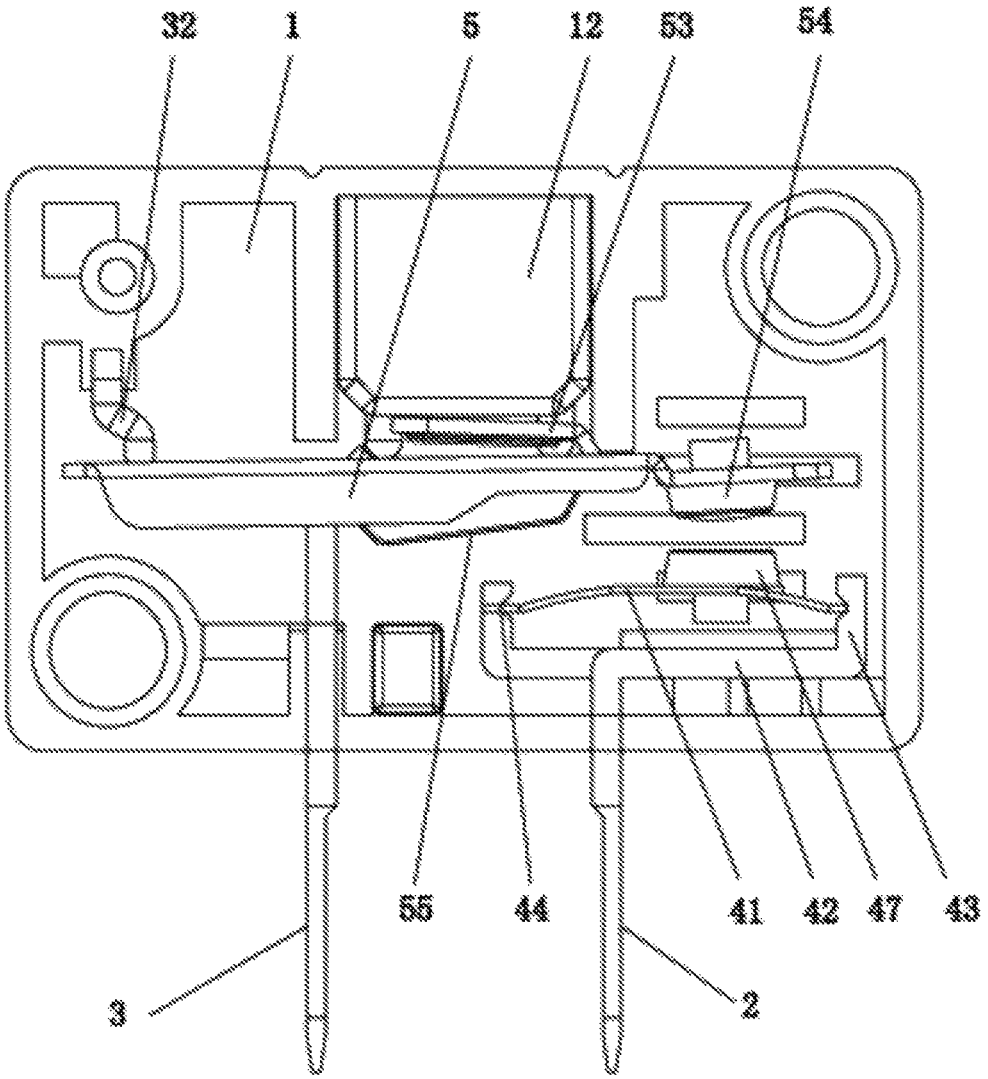
FIG. 2 is a structural diagram illustrating the internal assembly of the present invention.
Figure 3:
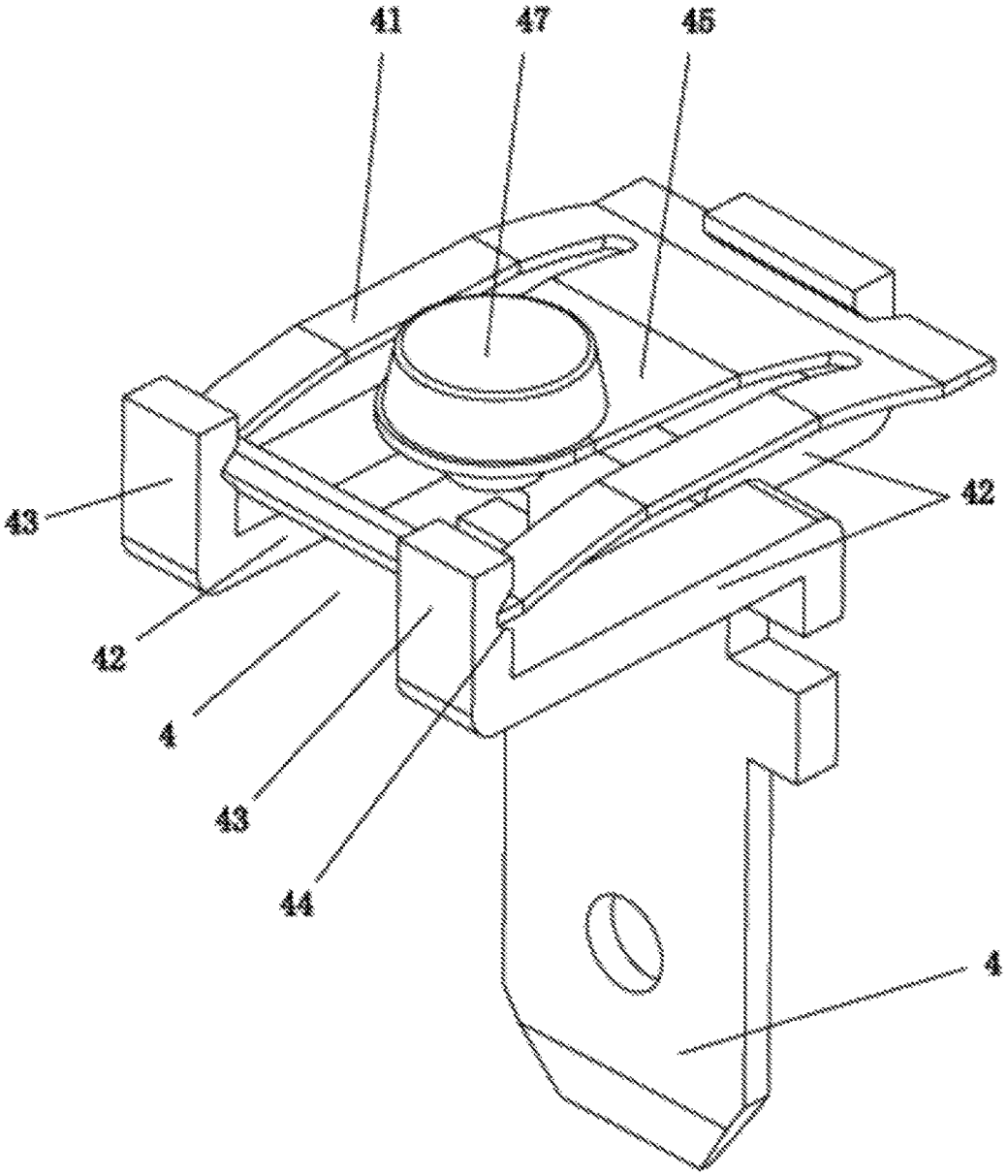
FIG. 3 is a structural diagram of the arc-removing apparatus of the present invention.

1, Housing; 2, Terminal A; 3, Terminal B; 4, Arc-removing Apparatus; 5, Tongue Plate; 11, Housing Cover; 12, Magnetic Body; 31, Transfer Plate; 32, Engaging Plate; 33, The Second Angled Slot; 34, Inclined Wedge Block; 41, Arc-removing Plate; 42, Fixing Claw; 43, Baffle; 44, The First Angled Slot; 45, Elastic Piece; 46, Fixing Hole; 47, Stationary Contact; 51, Mounting Slot; 52, Locating Slot; 53, Fixing Plate; 54, Movable Contact; 55, Supporting Piece; 56, Engaging Slot; 57, Insertion piece.

DETAILED DESCRIPTION OF THE INVENTION

Drawings and detailed embodiments are combined hereinafter to elaborate the technical principles of the present invention.

The novel magnetic switch of the present invention comprises a housing 1 having an open end, a terminal A2 and a terminal B3; a housing cover 11 is disposed at the open end of the housing 1; the terminal A2 and the terminal B3 are inserted in parallel into the housing 1 and the base plate of the housing cover 11; an inner cavity of the housing 1 is internally provided with a magnetic body 12 and a tongue plate 5; one end of the tongue plate 5 is movably connected to the upper end of the terminal B3; the magnetic body 12, which is integrally linked to the tongue plate 5, is capable of being raised thereon; the other end of the tongue plate 5 is disposed above the terminal A2; the upper end of the terminal A2 is provided with an arc-removing apparatus 4; the arc-removing apparatus 4 is provided with a stationary contact 47, and the other end of the tongue plate 5 is provided with a movable contact 54. The above constitutes the main structure of the present invention. Normally, the terminal A2 and the terminal B3 that insert into the housing and are connected to the electrodes are normally-open. One end of the tongue plate 5 is movably connected to the upper end of the terminal B3. The external magnetic body and the magnetic body 12 are magnetically repulsive to each other. When the external magnetic body gets nearer, the repulsive force pushes the magnetic body 12, thereby enabling the tongue plate 5 to rotate downward. The movable contact 54 on the tongue plate 5 contacts the stationary contact 47 on the arc-removing apparatus 4, thus switching-on the terminal A2 and the terminal B3. The arc-removing apparatus 4 can eliminate the electric arc generated when the circuit is closed, thereby avoiding the oxidation occurring to the contacts and improving the working stability and functional life of the present invention.

The arc-removing apparatus 4 comprises a three-clawed fixing frame. The three-clawed fixing frame, which is horizontally connected to the upper end of the terminal A2, is provided with an arc-removing plate 41. The arc-removing plate 41 is provided with a stationary contact 47. When the stationary contact 47 on the arc-removing plate is switched on, the high voltage generated by the initial current passes through the arc-removing plate 41, which prevents the oxidation caused by the high-voltage arc from occurring to the contacts.

The three-clawed fixing frame comprises three fixing claws 42 that are horizontally fixed to the upper end of the terminal A2, wherein two fixing claws 42 are disposed on one side of the upper end of the terminal A2, and the other fixing claw 42, which is disposed on the other side of the upper end of the terminal A2, is disposed between the said two fixing claws 42 disposed on one side of the terminal A2. The three-clawed fixing frame and the terminal A2 are molded in one body. The two ends of the arc-removing plate 41 are respectively connected to the fixing claws 42 disposed on the two sides of the terminal A2. The three fixing claws 42 are oppositely disposed at the upper end of the terminal A2, and the arc-removing plate 41 is fixed among the three fixing claws 42, thereby avoiding the oxidation from occurring to the contacts due to the instantaneous arc generated when the circuit is closed.

The outer end of the fixing claw 42 is vertically provided with a baffle 43, and the inner side surface of the baffle 43 is provided with a recessed first angled slot 44. The two end edges of the arc-removing plate 41 are correspondingly engaged with the first angled slots 44 of the baffles 43 disposed on two sides. The three fixing claws 42, the baffles 43, and the first angled slots 44 on the baffles 43 are molded in one body with the terminal A2.

The arc-removing plate 41 is configured as a flat, hollow-square. The inner hole of the arc-removing plate 41 is provided with an elastic piece 45. A fixing end of the elastic piece 45 is connected to the inner edge of one side plate of the arc-removing plate 41, and a free end of the elastic piece 45 can freely bounce within the arc-removing plate 41. The elastic piece 45 and the arc-removing plate 41 are configured to be an integral body. The other end of the elastic piece 45 is provided with a fixing hole 46, which is disposed to correspond to the other end of the tongue plate 5. The stationary contact 47 is connected to the fixing hole 46. The elastic piece 45 is made from temperature-sensitive bi-materials. When the temperature becomes too high due to the overload, the elastic piece 45 can push the stationary contact 47 to separate from the movable contact 54, thereby switching-off the circuit to protect the use safety of electrical appliances. The operating temperature of the elastic piece 45 is configured according to the variation range of the temperature rise and the environment temperature, and the reset temperature can be configured above 0° C. Further, the reset temperature is not less than 25° C., and the operating temperature is not less than 80° C.

The tongue plate 5 is provided with a mounting slot 51, and the upper end of the terminal B3 is provided with a transfer plate 31. The left end of the transfer plate 31 is provided with an inclined wedge block 34, and the right end of the transfer plate 31 is provided with an upright engaging plate 32. The outer side surface of the engaging plate 32 is provided with a recessed second angled slot 33. The engaging plate 32 is inserted into the mounting slot 51, and the inner edge of the tongue plate 5 disposed at the right end of the mounting slot 51 is engaged with the second angled slot 33. A curved elastic supporting piece 55 is disposed between the inclined wedge block 34 and the tongue plate 5 of the left end of the mounting slot 51. The two ends of the supporting piece 55 are respectively disposed at the two ends of the mounting slot 51. One end of the supporting piece 55 is disposed against the upper end of the terminal B3 through the inclined wedge block 34, and the other end of the supporting piece 55 is disposed against the tongue plate 5. Consequently, the tongue plate 5 rotates upward and downward at the upper end of the terminal B3, and the supporting plate 55 provides a reset supporting force to the tongue plate 5 to rotate upward.

The inclined wedge block 34 is configured to be T-shaped. The lower end of the upright plate of the inclined wedge block 34 is fixed to the transfer plate 31. The right end of the supporting piece 55 is provided with an engaging slot 56, and the engaging slot 56 is engaged with the upright plate of the inclined wedge block 34. The tongue plate 5 of the left end of the mounting slot 51 is provided with a locating slot 52. The left end of the supporting piece 55 is provided with an insertion piece 57, and the insertion piece 57 is inserted into the locating slot 52.

The tongue plate 5 of the left end of the mounting slot 51 is provided with a fixing plate 53. The magnetic body 12 is disposed on the fixing plate 53 and is integrally linked with the tongue plate 5. The fixing plate 53 is made from non-magnetic copper material.

The description of above embodiments allows those skilled in the art to realize or use the present invention. Without departing from the spirit and essence of the present invention, those skilled in the art can combine, change or modify correspondingly according to the present invention. Therefore, the protective range of the present invention should not be limited to the embodiments above but conform to the widest protective range which is consistent with the principles and innovative characteristics of the present invention. Although some special terms are used in the description of the present invention, the scope of the invention should not necessarily be limited by this description. The scope of the present invention is defined by the claims.

The invention claimed is:

1. A novel magnetic switch, comprising:

a housing having an open end, a terminal A, and a terminal B, wherein a housing cover is disposed at the open end of the housing, wherein the terminal A and the terminal B are inserted in parallel into the housing and the base plate of the housing cover, wherein an inner cavity of the housing is internally provided with a magnetic body and a tongue plate, wherein one end of the tongue plate is movably connected to the upper end of the terminal B, wherein the magnetic body is integrally linked to the tongue plate and is capable of being raised thereon, wherein the other end of the tongue plate is disposed above the terminal A, wherein the upper end of the terminal A is provided with an arc-removing apparatus, and wherein the arc-removing apparatus is provided with a stationary contact, and the other end of the tongue plate is provided with a movable contact, wherein the arc-removing apparatus comprises a three-clawed fixing frame, wherein the three-clawed fixing frame, which is horizontally connected to the upper end of the terminal A, is provided with an arc-removing plate, and wherein the arc-removing plate is provided with a stationary contact.

2. The novel magnetic switch of claim 1, wherein the three-clawed fixing frame comprises three fixing claws that are horizontally fixed to the upper end of the terminal A, wherein two fixing claws are disposed on one side of the upper end of the terminal A, and the other fixing claw, which is disposed on the other side of the upper end of the terminal A, is disposed between the said two fixing claws disposed on one side of the terminal A, and wherein the two ends of the arc-removing plate are respectively connected to the fixing claws disposed on the two sides of the terminal A.

3. The novel magnetic switch of claim 2, wherein the outer end of the fixing claw is vertically provided with a baffle, and the inner side surface of the baffle is provided with a recessed first angled slot, wherein the two end edges of the arc-removing plate are correspondingly engaged with the first angled slots of the baffles disposed on two sides.

4. The novel magnetic switch of claim 3, wherein the arc-removing plate is configured in the shape of a flat hollow square, wherein the inner hole of the arc-removing plate is provided with an elastic piece, wherein a fixing end of the elastic piece is connected to the inner edge of one side plate of the arc-removing plate, and a free end of the elastic piece can freely bounce within the arc-removing plate, wherein the elastic piece and the arc-removing plate are configured to be an integral body, wherein the other end of the elastic piece is provided with a fixing hole, which is disposed to correspond to the other end of the tongue plate, and wherein the stationary contact is connected to the fixing hole.

5. The novel magnetic switch of claim 2, wherein the arc-removing plate is configured in the shape of a flat hollow square, wherein the inner hole of the arc-removing plate is provided with an elastic piece, wherein a fixing end of the elastic piece is connected to the inner edge of one side plate of the arc-removing plate, and a free end of the elastic piece can freely bounce within the arc-removing plate, wherein the elastic piece and the arc-removing plate are configured to be an integral body, wherein the other end of the elastic piece is provided with a fixing hole, which is disposed to correspond to the other end of the tongue plate, and wherein the stationary contact is connected to the fixing hole.

6. The novel magnetic switch of claims 1 wherein the arc-removing plate is configured in the shape of a flat hollow square, wherein the inner hole of the arc-removing plate is provided with an elastic piece, wherein a fixing end of the elastic piece is connected to the inner edge of one side plate of the arc-removing plate, and a free end of the elastic piece can freely bounce within the arc-removing plate, wherein the elastic piece and the arc-removing plate are configured to be an integral body, wherein the other end of the elastic piece is provided with a fixing hole, which is disposed to correspond to the other end of the tongue plate, and wherein the stationary contact is connected to the fixing hole.

7. The novel magnetic switch of claim 1, wherein the tongue plate is provided with a mounting slot, and the upper end of the terminal B is provided with a transfer plate, wherein the left end of the transfer plate is provided with an inclined wedge block, and the right end of the transfer plate is provided with an upright engaging plate, wherein the outer side surface of the engaging plate is provided with a recessed second angled slot, wherein the engaging plate is inserted into the mounting slot, and the inner edge of the tongue plate disposed at the right end of the mounting slot is engaged with the second angled slot, and wherein a curved elastic supporting piece is disposed between the inclined wedge block and the tongue plate of the left end of the mounting slot.

8. The novel magnetic switch of claim 7, wherein the inclined wedge block is configured to be T-shaped, wherein the lower end of the upright plate of the inclined wedge block is fixed to the transfer plate, wherein the right end of the supporting piece is provided with an engaging slot, and the engaging slot is engaged with the upright plate of the inclined wedge block, wherein the tongue plate of the left end of the mounting slot is provided with a locating slot, and wherein the left end of the supporting piece is provided with an insertion piece, and the insertion piece is inserted into the locating slot.

9. The novel magnetic switch of claim 7, wherein the tongue plate of the left end of the mounting slot is provided with a fixing plate, wherein the magnetic body is disposed on the fixing plate and is integrally linked with the tongue plate, and wherein the fixing plate is made from non-magnetic copper material.

* * * * *